United States Patent [19]

Baldridge

[11] Patent Number: 5,050,673

[45] Date of Patent: Sep. 24, 1991

[54] LIFT THROUGH PLUG CONTAINER FOR SLANT RIG

[75] Inventor: Morris G. Baldridge, Duncan, Okla.

[73] Assignee: Halliburton Company, Duncan, Okla.

[21] Appl. No.: 523,787

[22] Filed: May 15, 1990

[51] Int. Cl.[5] ..... E21B 23/10; E21B 33/05

[52] U.S. Cl. ..... 166/70; 166/90; 166/291

[58] Field of Search ..... 166/291, 90, 70, 153–156; 175/162, 203, 220

[56] References Cited

U.S. PATENT DOCUMENTS

| | | | |
|---|---|---|---|
| 2,196,652 | 4/1940 | Baker | 166/70 |
| 2,615,519 | 10/1952 | Carr | 166/70 |
| 2,630,179 | 3/1953 | Brown | 166/14 |
| 2,647,582 | 8/1953 | Brown et al. | 166/1 |
| 2,984,301 | 5/1961 | Scott | 166/70 |
| 3,076,509 | 2/1963 | Burns et al. | 166/70 |
| 3,616,850 | 11/1971 | Scott | 166/155 |
| 3,777,819 | 12/1973 | Delano | 166/285 |
| 4,246,967 | 1/1981 | Harris | 166/291 |
| 4,290,482 | 9/1981 | Brisco | 166/70 |
| 4,427,065 | 1/1984 | Watson | 166/70 |
| 4,624,312 | 11/1986 | McMullin | 166/155 |

OTHER PUBLICATIONS

Exhibit A–Drawing of Cement Head Apparatus Sold by Nodeco (undated but admitted to be prior art).

Exhibit B–Oil & Gas Journal, May 14, 1984, pp. 72–74, article entitled "Slant Holes Cap Shallow Gas Under Lake".

Exhibit C–Copy of Cover and p. 2423, of Halliburton Services Sales & Service Catalog No. 43, published 1985.

Exhibit D–Advertising Brochure Dated 7–15–81, of Halliburtoon Company.

Exhibit E–Two Drawings of a Cementing Head Apparatus (undated but admitted to be prior art).

Exhibit F–Advertising Brochure for a Roto–Tek Cementing System (undated but admitted to be prior art).

Exhibit G–Advertisement for a Cementing Manifold Sold by Lindsey Completion Systems (undated but admitted to be prior art).

*Primary Examiner*—Bruce M. Kisliuk

*Attorney, Agent, or Firm*—James R. Duzan; L. Wayne Beavers

[57] ABSTRACT

A system for cementing a casing string in a slant well includes a slant drilling rig including a slanted mast having a pair of spaced rails with an elevator spanning between the rails and reciprocable along a length thereof for reciprocating a casing string with the casing string lying generally between and parallel to the rails. The mast has an open generally upward facing side. A cement plug container apparatus has a cementing manifold and a release plunger assembly attached thereto and positioned about the container relative to each other such that an angle of substantially less than 180°, and most preferably approximately 980°, is defined therebetween. Thus, the container is substantially free of any radial protrusions outside of that angle and can lie generally flat within the confines of the space between the rails of the tilted mast. The container is of a lift through design having a lifting sub attached to the upper end thereof so that the container and a casing string supported therefrom can be reciprocated within the slant rig so as to reciprocate the casing string while cementing the same in place.

13 Claims, 3 Drawing Sheets

LIFT THROUGH PLUG CONTAINER FOR SLANT RIG

BACKGROUND OF THE INVENTION

1. Field Of The Invention

The present invention relates generally to cement plug containers, and more particularly, but not by way of limitation, to a lift through cement plug container for use with a slant drilling rig.

2. Description Of The Prior Art

It is common in the drilling of wells to utilize various forms of directional drilling to control the path of a bore hole as it is drilled into the earth.

One technique which has been developed is the use of a slanted drilling rig having a tilted mast, so that the bore hole actually enters the earth's surface at an angle determined by the angle of tilt of the mast. Such a slant drilling rig is described, for example, in *Oil & Gas Journal,* May 14, 1984, pages 72–74, in the article entitled "Slant Holes Tap Shallow Gas Under Lake".

These slant rigs include a tilted mast having a pair of spaced rails with an elevator spanning between the rails. The elevator moves along a length of the rails for reciprocating a drill string or casing string supported thereby. The mast is open on its generally upward facing side to provide access to the pipe string supported from the elevator.

Various types of plug containers are also known to the art. For example, the assignee of the present invention markets through its Halliburton Services Division a Jet-Hed TM III plug container such as that shown in Halliburton Services Sales & Service Catalog No. 43 at page 2423 (1985). A similar plug container having modified fluid inlets is shown in U.S. Pat. No. 4,290,482 to Brisco, and also assigned to the assignee of the present invention. Cement plug containers like those just cited are not "lift through" designs in that they are not designed to support the weight of the casing string through the structure of the plug container. Instead, the casing string must be supported at some point below the plug container.

Also known to the art are cementing heads of the "lift through" design wherein the entire weight of the drill pipe which is hung below the drilling platform is supported through or lifted through the structure of the cementing head. One such system is that known as the Nodeco system which is shown in Exhibit A filed herewith. The Nodeco system utilizes a lifting sub attached to the upper end of a container body. The container body does not hold a cement plug. Instead, it contains balls and darts which are dropped to a subsurface plug container wherein the actual cementing plugs are activated by the balls and darts.

In all of the cement plug container or cementing head designs cited above, the cement line manifolds and plunger assemblies are typically arranged so that they span at least 180° about the axis of the container, and in many cases projections from the container protrude in all quadrants about the container. Accordingly, these typical prior art containers are problematic when utilized with a slant rig like that discussed above wherein the pipe string and any associated apparatus such as a cement plug container must be suspended from the elevator between the rails of the tilted mast.

There is a need for a cement plug container particularly adapted for use with slant rigs.

SUMMARY OF THE INVENTION

A system for cementing a casing string in a slant well includes a slant drilling rig having a tilted or slanted mast. The mast has a pair of spaced rails with an elevator spanning between the rails and reciprocable along the length thereof for reciprocating the casing string with the casing string line generally between and parallel to the rails. The mast has an open, generally upward facing side providing access to the casing string.

A cement plug container apparatus for use with the slant drilling rig includes a container body having an upper end and a lower end. The lower end is connected to the casing string by an adapter. A lifting sub is attached to the upper end of the container body and is operably engaged with the elevator of the slant rig so that the casing string and cement plug container apparatus are reciprocable by the elevator. The casing string is lifted through or supported through the structure of the container body.

The cement plug container apparatus includes a cementing manifold attached to the container body and extending generally radially outward therefrom. A release plunger assembly is also attached to the container body and extends generally radially outward therefrom. The plunger assembly and manifold are positioned on the container body relative to each other so that an angle of substantially less than 180° is defined therebetween.

The cement plug container apparatus is arranged relative to the tilted mast so that the cementing manifold and plunger assembly extend toward the open upper side of the mast so that there is no interference between the side rails of the mast and the structure of the plunger assembly or the cementing manifold. A peripheral portion of the container body outside of the angle defined between the plunger assembly and cementing manifold is substantially free of lateral protrusions and faces toward the closed bottom side of the mast.

With this arrangement, the casing string can be reciprocated through the cement plug container apparatus while cementing the casing string in place.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
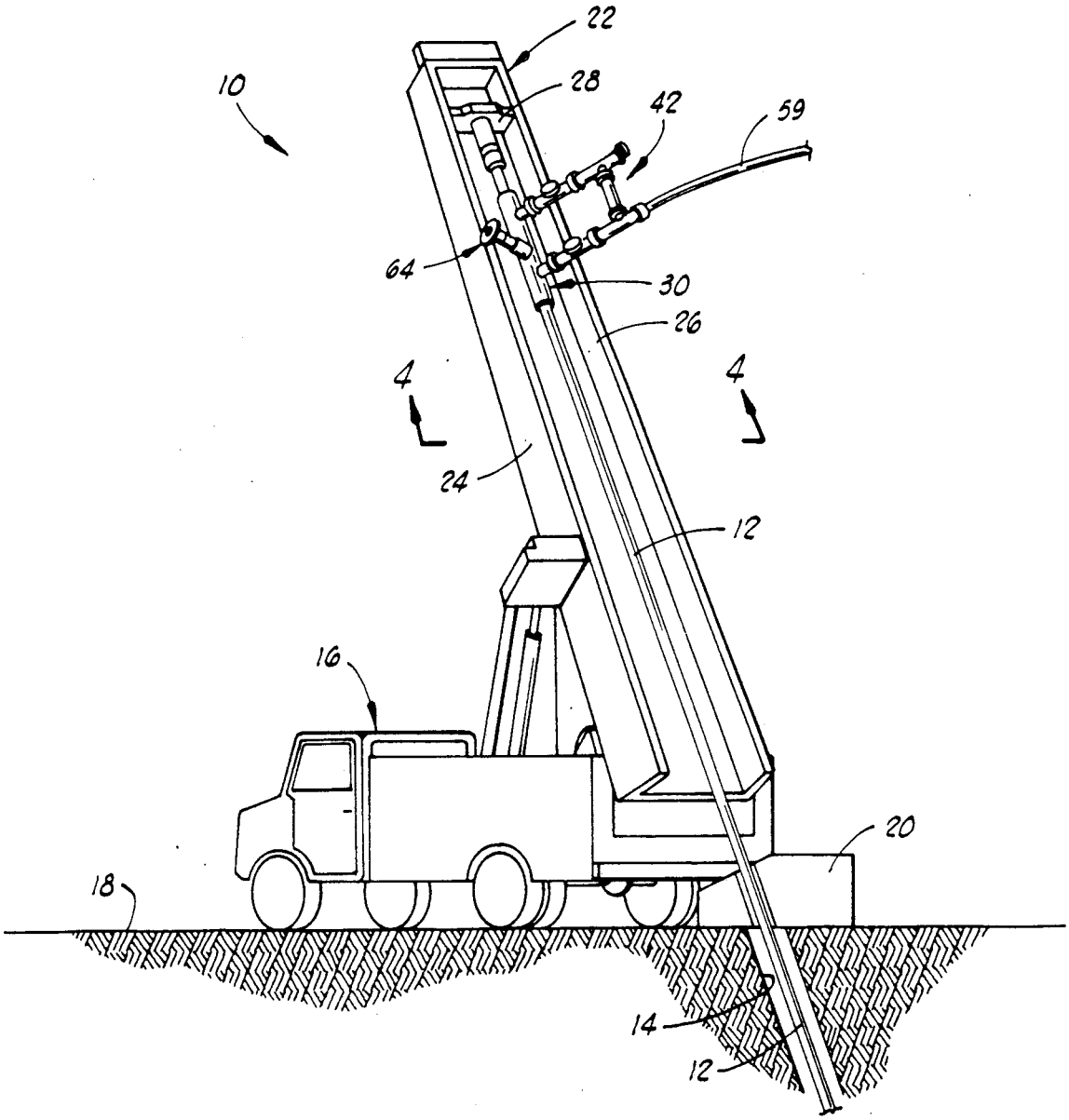
FIG. 1 is a schematic isometric view of a slant drilling rig with the cement plug container apparatus of the present invention and a string of well casing assembled therewith.

Referring now to the drawings and particularly to FIG. 1, a system 10 for cementing a casing string 12 within a slanted bore hole 14 is schematically illustrated.

A slant drilling rig generally designated by the numeral 16 sits on the earth's surface 18 and drills the slanted bore hole 14 through a blowout preventer assembly schematically illustrated as 20.

The slant rig includes a tilted or slanted mast 22 typically tilted at an angle of about 30° to the vertical. The mast 22 includes a pair of spaced parallel rails schematically illustrated as 24 and 26. An elevator 28 spans between the rails 24 and 26 and is reciprocable along the length of rails 24 and 26 for lowering drill pipe strings or casing strings into the bore hole 14. The casing string 12 is shown suspended from elevator 28 through a cement plug container apparatus 30.

Figure 4:
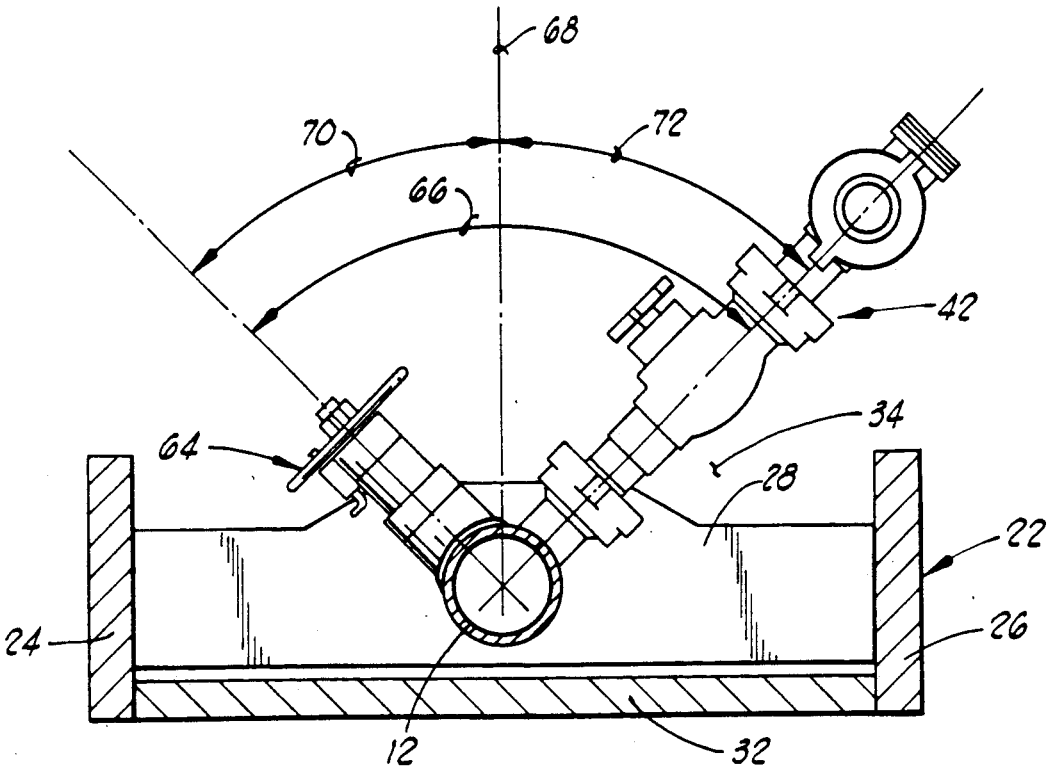
FIG. 4 is a sectioned view taken along line 4–4 of FIG. 1 showing the preferred orientation of the cement plug container apparatus within the slant drilling rig.

As best seen in the section view of FIG. 4, the mast 22 has a closed generally downward facing side 32 and an open generally upward facing side 34.

Figure 2:
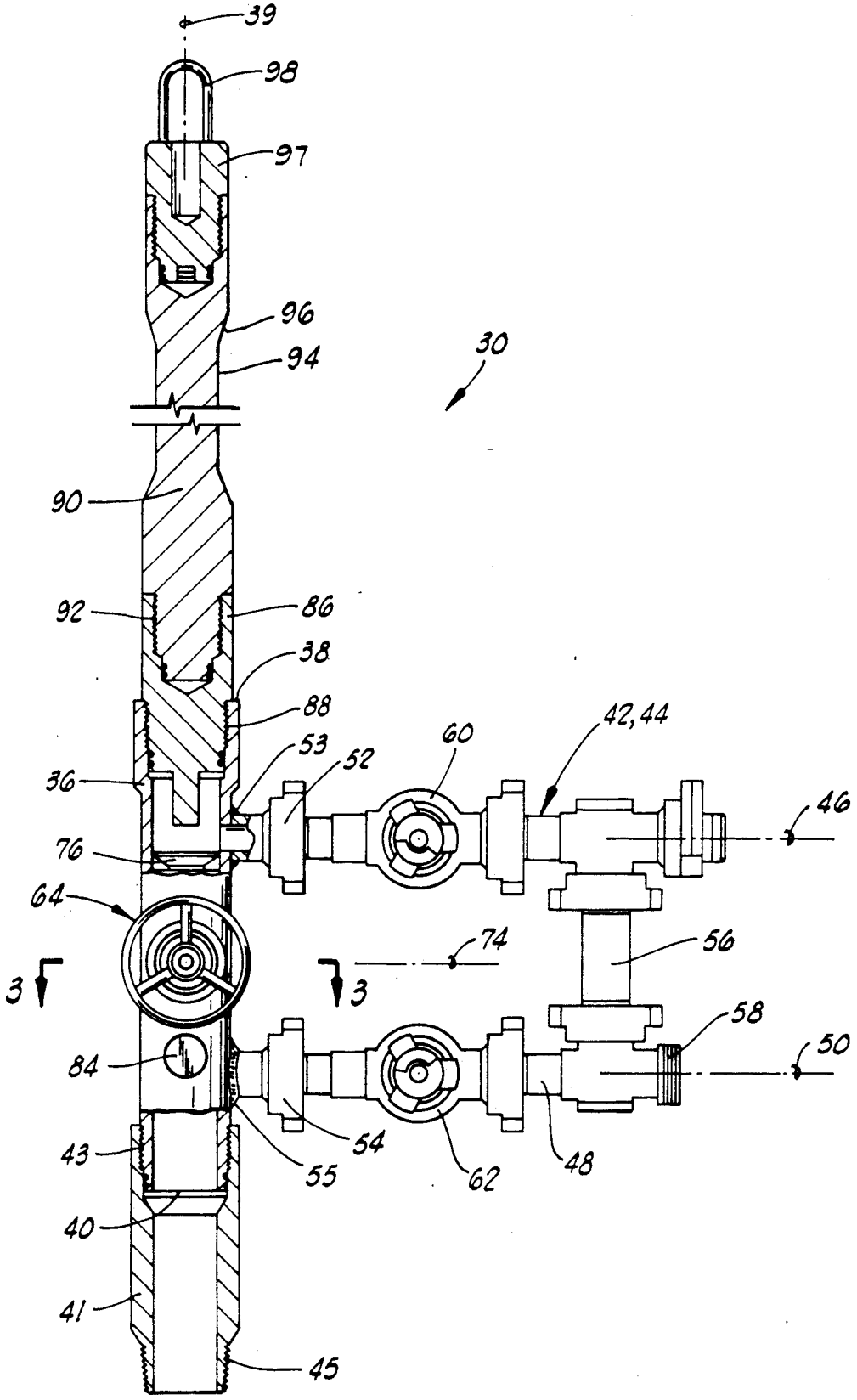
FIG. 2 is an elevation partly sectioned view of the cement plug container apparatus of the present invention.

Referring now to FIG. 2, the details of construction of the cement plug container apparatus 30 are best seen. The apparatus 30 includes a container body 36 having an upper end 38 and a lower end 40 defining longitudinal axis 39 therebetween. An adapter 41 is threadedly connected at 43 to the lower end 40 of container body 36. A threaded casing pin connection 45 at the lower end of adapter 41 is constructed to be threadedly engaged in the upper box end of an uppermost joint of casing of the casing string 12. The use of adapter 41 allows the threads 45 to be easily repaired as they become worn.

Figure 3:
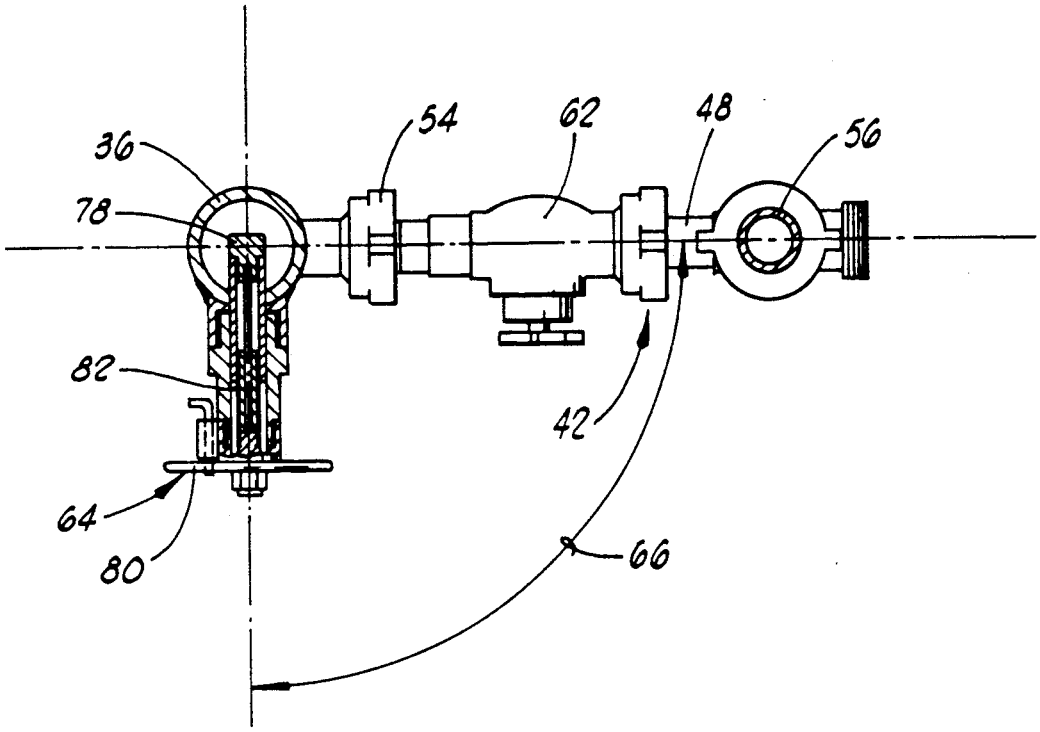
FIG. 3 is a plan sectioned view taken along line 3—3 of FIG. 2.

A cementing manifold generally designated by the numeral 42 is attached to the container body 36 and extends generally radially outward therefrom as best seen in FIG. 3. The cementing manifold 42 includes an upper cementing line 44 connected to container body 36 at an upper elevation 46, and a lower cementing line 48 connected to container body 36 at a lower elevation 50.

The upper cementing line 44 is connected to container body 36 by a first hammer union 52 which is welded to container body as indicated at 53, and the lower cementing line 48 is connected to container body 36 by a second hammer union 54 which is welded to container body 36 as indicated at 55. By use of the welded hammer unions 52 and 54, the line pipe threads which are typical with most plug containers are eliminated.

The upper and lower cementing lines 44 and 48 are communicated by a vertical conduit 56. Cement and other fluids will be provided to the cementing manifold 42 at an inlet 58 from a fluid supply line 59 (see FIG. 1). Valves 60 and 62 are disposed in the upper and lower cementing lines 44 and 48, respectively.

As will be understood by those skilled in the art, the valves 60 and 62 are used to control the flow of cement and other fluids so that they can be selectively diverted either to the upper end or lower end of the container body 36.

The cement plug container apparatus 30 also includes a release plunger assembly generally designated by the numeral 64 which is attached to container body 36 and extends radially outward therefrom.

As is best seen in FIG. 3, the plunger assembly 64 and the cementing manifold 42 are positioned on the container body 36 relative to each other such that an angle 66 is defined therebetween. In the illustrated preferred embodiment, the angle 66 is approximately 90°.

The purpose of this orientation of the cementing manifold 42 and plunger assembly 64 is to provide a container body 36 which is substantially free of any lateral protrusions projecting away from the open side 34 of the tilted mast 22 or toward the side rails 24 or 26 of tilted mast 22, so that the casing string 12 with attached cement plug container apparatus 30 can be reciprocated within the tilted mast 22 while cementing through the cement plug container apparatus 30. Container body 36 can also be described as being substantially free of any radial protrusions in the approximately 270° circumferential portion of container body 36 seen in FIG. 3 which is outside of the angle 66. With the cementing manifold 42 and all miscellaneous exterior attachments such as plunger assembly 64 positioned within the approximately 90° angle 66, the container body 36 is permitted to lay flat within the rail system of mast 22.

As best seen in FIG. 4, the cement plug container apparatus 30 is preferably oriented within the mast 22 such that an imaginary line 68 dividing the angle 66 into two equal portions 70 and 72 extends generally normally to the open generally upward facing side 34 of mast 22. Thus, the cementing manifold 42 and plunger assembly 64 are oriented so that sliding motion thereof relative to mast 22 will not be interferred with by the side rails 24 and 26.

Generally, the preferred angle 66 can be defined as substantially less than 180° so that the cementing manifold 42 and plunger assembly 64 will clear the side rails 24 and 26 thus permitting sliding motion of the cement plug container apparatus 30. More specifically, the preferred angle 66 can be specified as being no greater than about 135°. Still more specifically, the preferred angle 66 can be specified as being no greater than about 90°. In the preferred embodiment illustrated, the angle 66 is approximately 90°.

Referring again to FIG. 2, it is seen that the plunger assembly 64 is longitudinally positioned on the container body 36 at an intermediate elevation 74 which is between the upper and lower elevations 46 and 50. This can also be described as longitudinally positioning the plunger assembly 64 on a longitudinal portion of the container body between elevations 46 and 50 spanned by the cementing manifold 42 so that the plunger assembly 64 is required to be angularly offset from cementing manifold 42 in order to avoid interference therewith.

The cement plug container apparatus 30 includes a multi-wipered cementing plug 76, the upper portion of which is visible in FIG. 2. The cementing plug 76 is preferably a five wiper plug and it is dimensioned to sealingly engage the inner diameter of casing string 12. The cementing plug 76 is initially retained in the container body 36 by the plunger assembly 64. The cementing plug 76 is generally located between the upper elevation 46 and the intermediate elevation 74.

The general construction of the plunger assembly 64 is best seen in the sectioned view of FIG. 3. A cylindrical release plunger 78 is operably associated with the container body 36 and is movable between a first position as shown in FIG. 3 wherein the plunger 78 extends into the bore of the container body 36. A hand wheel 80 is rotated to cause the cylindrical plunger 78 to move radially outward along a threaded shaft 82 to a second position (not shown) wherein the plunger 78 is completely withdrawn from the bore of container housing 36. When the plunger 78 is moved to its second withdrawn position, the cement plug 76 may be pumped down through the casing string 12 by diverting fluid through the upper cementing line 44 of cementing manifold 42. An indicator assembly 84 (see FIG. 2) is located immediately below plunger assembly 64 for indicating when the cementing plug 76 has dropped therethrough.

The cement plug container apparatus 30 includes an upper cap 86 threadedly connected to container body 36 at thread 88. Upper cap 86 is easily removable for loading the cement wiper plug 76. A lifting sub 90 is threadedly connected to cap 86 at thread 92, and thus can be said to be attached to the upper end of container body 36. The threads 88 and 43 at the upper and lower ends of container body 36 are straight thread connections with 0-ring seals for easy removal thereof. The plug container 36 is designed with a 4½ API IF box thread at threaded connection 92 for installing the lifting sub 90.

The lifting sub 90 has a reduced diameter external surface 94 and a downward facing tapered shoulder 96 which is engaged by the elevator 28 in order to lift the cement plug container apparatus 30 and casing string 12 suspended therefrom. An upper cap 97 is threadedly connected to the upper end of sub 90 and has a handle loop 98 attached thereto for handling of cap 97.

With this system 10, the casing string 12 can be lifted through, that is supported from, the cement plug container apparatus 30 by the elevator 28. Thus, while the casing string 12 is being cemented in the well, the elevator 28 can be utilized to reciprocate the casing string 12 while cement is being pumped downward therethrough and up into the annulus between casing string 12 and bore hole 14. As will be understood by those skilled in the art, the reciprocating manipulation of the casing string 12 during the cementing operation is very desirable in that it aids in placement of the cement within the well annulus.

With the construction of the cement plug container apparatus 30 set forth above, such reciprocation of the casing string 12 is achievable in a slant drilling rig without encountering any interference of fluid supply line 59, the cementing head 42 or plunger assembly 64 with the side rails 24 and 26 of the mast 22.

The lift through style cement plug container apparatus 30 shown in FIG. 2, in a preferred embodiment thereof, is designed for a maximum lift of 25 tons with 5,000 psi internal casing pressure.

Thus it is seen that the apparatus of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A cement plug container apparatus, comprising:

a lift through container body having an upper end and a lower end defining a longitudinal axis therebetween;

a cementing manifold attached to said container body and extending generally radially outward therefrom;

a plug release assembly attached to said container body and extending generally radially outward therefrom;

said plug release assembly and said manifold being positioned on said container body relative to each other such that an angle of no greater than about 135° about said longitudinal axis of said container body is defined between said plug release assembly and said manifold, said container body being substantially free of any radial protrusions outside said angle; and a lifting sub means attached to said upper end of said container body for lifting said container body and a casing string supported from a lower end thereof.

2. The apparatus of claim 1, wherein said angle is no greater than about 90°.

3. The apparatus of claim 1, wherein said angle is approximately 90°.

4. The apparatus of claim 1, wherein said plug release assembly is longitudinally positioned on a longitudinal portion of said container body spanned by said cementing manifold so that said plug release assembly is required to be angularly offset from said cementing manifold.

5. The apparatus of claim 1, wherein:

said cementing manifold includes an upper cementing line connected to said container body at an upper elevation, and a lower cementing line connected to said container body at a lower elevation;

said plug release assembly is attached to said container body at an intermediate elevation between said upper and lower elevations; and said apparatus further includes a multi-wipered cementing plug dimensioned to sealingly engage an inner diameter of said casing string, said plug being initially retained in said container by said plug release assembly between said upper elevation and said intermediate elevation.

6. A system for cementing a casing string in a slant well, comprising:

a slant drilling rig including a slanted mast having a pair of spaced rails with an elevator reciprocable along a length of said rails for reciprocating said casing string with said casing string lying generally between and parallel to said rails, said mast having an open generally upward facing side; and a cement plug container apparatus, including:

a container body having an upper end and a lower end, said lower end being connected to said casing string;

a lifting sub attached to said upper end of said container body and operably engaged with said elevator so that said casing string and cement plug container apparatus are reciprocable by said elevator;

a cementing line attached to said container body and extending laterally therefrom toward said open side of said mast;

a release plug assembly attached to said container body and extending laterally therefrom toward said open side of said mast; and said container body being substantially free of any lateral protrusions projecting away from said open side of said mast or toward said rails so that said casing string can be reciprocated while cementing through said cement plug container apparatus.

7. The system of claim 6, wherein:

said plug release assembly and said cementing line are positioned on said container body relative to each other such that an angle of no greater than about 135° about a longitudinal axis of said container body is defined between said plug release assembly and said cementing line.

8. The apparatus of claim 7, wherein said angle is no greater than about 90°.

9. The apparatus of claim 7, wherein said angle is approximately 90°.

10. The system of claim 9, wherein:

an imaginary line dividing said angle into two equal portions extends generally normal to said open generally upward facing side of said mast.

11. The system of claim 7, wherein:

an imaginary line dividing said angle into two equal portions extends generally normal to said open generally upward facing side of said mast.

12. The system of claim 7, wherein:

said cementing line is part of a cementing manifold; and said plug release assembly is longitudinally positioned on a longitudinal portion of said container body spanned by said cementing manifold so that said plug release assembly is required to be angularly offset from said cementing manifold.

13. The system of claim 6, wherein:

said cementing line is an upper cementing line of a cementing manifold which includes said upper cementing line connected to said container body at an upper elevation and a lower cementing line connected to said container body at a lower elevation;

said plug release assembly is attached to said container body at an intermediate elevation between said upper and lower elevations; and said apparatus further includes a multi-wipered cementing plug dimensioned to sealingly engage an inner diameter of said casing string, said plug being initially retained in said container by said plug release assembly between said upper elevation and said intermediate elevation.

* * * * *